US006138547A

United States Patent [19]

Larsson et al.

[11] Patent Number: 6,138,547

[45] Date of Patent: Oct. 31, 2000

[54] PROGRAMMABLE BARREL WEAPON

[75] Inventors: Rolf Larsson; Nils Johansson; Erik Fohrman; Björn Hagström; Sven-Åke Jern, all of Karlskoga, Sweden

[73] Assignee: Bofors AB, Karlskoga, Sweden

[21] Appl. No.: 09/171,127

[22] PCT Filed: Apr. 11, 1997

[86] PCT No.: PCT/SE97/00607

§ 371 Date: Jan. 13, 1999

§ 102(e) Date: Jan. 13, 1999

[87] PCT Pub. No.: WO97/39304

PCT Pub. Date: Oct. 23, 1997

[30] Foreign Application Priority Data

Apr. 18, 1996 [SE] Sweden ..... 9601468

[51] Int. Cl.[7] ..... F42C 17/00

[52] U.S. Cl. ..... 89/6.5; 102/265; 102/270

[58] Field of Search ..... 89/6, 6.5; 102/265, 102/270

[56] References Cited

U.S. PATENT DOCUMENTS

| | | | |
|---|---|---|---|
| 1,897,863 | 2/1933 | Ruhlemann | 89/1.1 |
| 4,005,631 | 2/1977 | Kaiser et al. | 89/6.5 |
| 4,649,796 | 3/1987 | Schmidt | 89/6.5 |
| 4,664,013 | 5/1987 | Wegner et al. | 89/6.5 |
| 4,711,152 | 12/1987 | Fortunko | 89/6.5 |
| 4,979,424 | 12/1990 | Becker et al. | 89/6.5 |
| 5,117,732 | 6/1992 | Munzel et al. | 89/6.5 |

FOREIGN PATENT DOCUMENTS

| | | |
|---|---|---|
| 0 118 122 Al | 9/1984 | European Pat. Off. . |
| 0 300 255 B1 | 4/1991 | European Pat. Off. . |
| 0 467 055 B1 | 10/1993 | European Pat. Off. . |

*Primary Examiner*—Charles T. Jordan
*Assistant Examiner*—Michelle Thomson
*Attorney, Agent, or Firm*—Pollock, Vande Sande & Amernick, R.L.L.P.

[57] ABSTRACT

A shell-firing barrel weapon system for a single shot, semi-automatic or fully automatic firing, including a rifled barrel comprising a programming member for programming with programming pulses fuses in shells fired from the weapon before or in conjunction with firing of the shells. At least one contact is located in the barrel of the weapon and connected to the programming member for transmitting a programming pulse from the programming member to the fuses of the shells. The at least one contact is electrically insulated from the barrel and protrudes into the barrel beyond bars of rifling of the barrel. An electrically conductive contact ring is concentrically arranged on the shells. The contact ring is electrically insulated from main parts of the shells and has an external diameter that is smaller than a diameter of the bars of the rifling of the barrel. The contact ring is positioned on the shells such that when the shell is located in a cartridge chamber of the weapon the contact ring directly contacts the contact device. Electric feedback of a programming pulse from the programming member takes place via contact between the main parts of the shells and an inside of the barrel of the weapon.

12 Claims, 1 Drawing Sheet

PROGRAMMABLE BARREL WEAPON

FIELD OF THE INVENTION

The present invention relates to a shell-firing barrel weapon system provided with a rifled barrel preferably made of steel or other electrically conductive material and designed to fire, as single-shot, semiautomatic or fully automatic fire, explosive-filled shells provided with programmable electronic fuses.

BACKGROUND OF THE INVENTION

For the weapon system in question, it is generally the case that it will include a programming member of a known type which, on command, generates electric programming signals which are to be passed onto the shells. Since the programming member, and the type of programming signals which it generates are of a type known, these features will not be described more closely.

The invention instead relates to how the weapon system is to be designed so that it will be possible to supply the electric programming signals to the electronic fuse function of the shells while the shells are located in the cartridge chamber of the weapon inside the barrel where they are surrounded by electrically conductive and, in the great majority of cases, magnetic material. For effectiveness, it is desirable to program fuses as late as possible which means that this should be done immediately before, or in conjunction with firing.

Programming the fuse of the shells inside the cartridge chamber is therefore, in theory, the best place if possibility of doing this after the shell has left the barrel and is on its way towards the target is discounted. EP-A-0300255 and EP-A-0467055 describe how programming can be carried out with the aid of electromagnetic coils arranged immediately outside the mouth of the barrel. For various reasons, these solutions have proved to be more difficult to implement in practice than was originally theoretically assumed. Then, as far as programming further away from the firing point is concerned, along the actual missile trajectory, this involves such great technical complications that, although they are by no means insurmountable, they would probably only be justified in terms of effectiveness in larger calibers such as 10.5 cm and above.

In addition to the alternatives indicated above of programming the shells when they are on the way towards the target, or in the cartridge chamber of the weapon, the current most common method of programming the shells is programming before the shell is supplied to the weapon and also the procedure which is used in certain automatic pieces in which the shell is programmed at the same time as it is transferred from the magazine of the weapon to the cartridge chamber of the weapon.

None of these methods is suitable in weapons which may stand with a shell in the cartridge chamber for long periods without firing. The only alternative remaining then is actually to program the fuse of the shell in the cartridge chamber of the weapon or immediately outside thereof. In theory, both these procedures also represent good opportunities for programming the detonation range for the shells of the relative shots in a volley.

SUMMARY OF THE INVENTION

The present invention relates to a solution to the problems indicated above. The invention therefore relates to a shell-firing barrel weapon system for single-shot, semi-automatic or fully automatic firing provided with a rifled barrel preferably made of steel. The weapon system in question comprises, in addition to usual components such as a barrel, breech block and possibly an ammunition-feeding system, magazine, sights etc., a programming system designed according to the prior art intended to program, by means of electric pulses, the electronic time fuse which is to form part of the explosive-filled shells which belong to the weapon system. As has already been indicated, the programming system is of a known type per se. The purpose of the programming is to provide detonation at the desired range. The programming therefore relates to range/time detonation.

According to the invention, the barrel of the weapon is now to be equipped, for transmitting the programming pulse concerned from the programming member of the weapon to the fuse of the shell, with at least one, and perhaps, to ensure good contact, preferably three, contact devices or pins which are electrically connected to the programming member. Such devices or pins may be incorporated into the barrel wall of the weapon and electrically insulated from this. Also these may protrude into the barrel a little beyond the bars of the rifling of the barrel while the respective shells have an electrically conductive contact ring or contact band which is arranged concentrically, let into the shell body, electrically insulated from the main part of the shell and which has an external diameter which is slightly smaller than the diameter of the bars of the rifling of the barrel. The above contact ring or band may be positioned in such a manner on the respective shell, that when the shell is located in the cartridge chamber of the weapon, the ring lies in direct contact with the contact pin, and the electric feedback of the programming pulse takes place via contact between the main part of the shell and the inside of the barrel.

In order to ensure feedback between shell and barrel, the shell body can moreover be provided with a rim or collar in the form of a ring made of an easily deformed electrically conductive material, such as copper or aluminium, which has a diameter slightly greater than the minimum diameter of the barrel at the level of the cartridge chamber. As result of this it will be deformed when the shell is rammed home in the cartridge chamber and consequently give rise to a play-free electric connection against the barrel material.

A further advantage of the direct connection which is obtained according to the present invention is that primary charging and top-up charging of the capacitors included in the electronic fuses of the shells can be carried out via the same channels that are used for programming the fuses. Even if primary charging of the capacitors is carried out before the shells are supplied to the cartridge chamber, top-up charging can take place later in the cartridge chamber.

The shell-firing barrel weapon system according to the invention will now be explained in greater detail in conjunction with the attached figures.

These figures relate to an example of how the invention can be used in a so-called shell sprayer which is a fully automatic barrel weapon which fires explosive-filled shells. The invention is not, however, restricted to use in this type of weapon alone but can be used within the entire area which has been defined in the patent claims. The figures show only those parts of the weapon system (shell sprayer) concerned which are necessary to understand the invention. The remaining parts of the weapon are conventional.

DETAILED DESCRIPTION OF THE PREFERRED EMBODIMENT

Corresponding parts have the same reference numbers in both figures.

Figure 1:
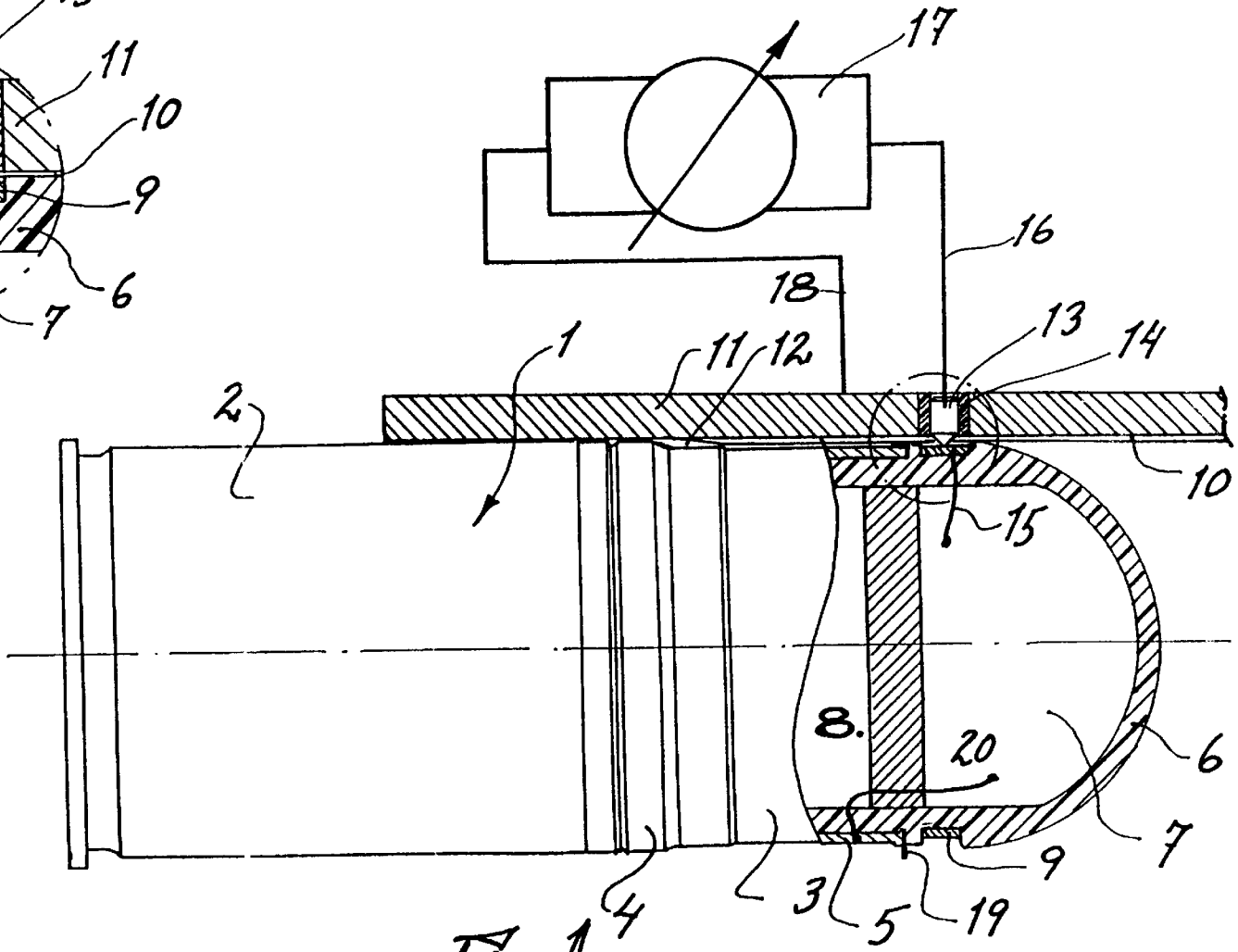
FIG. 1 shows a partly sectioned longitudinal projection of the shell in question, in which the upper half of the figure shows the shell as a part of the complete shot for a shell sprayer introduced into the cartridge chamber of the weapon in question and the lower half of the figure shows the same complete shot before it has been rammed home in the cartridge chamber.

The complete shot 1 in FIG. 1 comprises a casing 2 and an explosive-filled shell 3. The latter is provided with a thrust band 4 made of copper or plastic and its rear, largely explosive-filled part 5 made of metal while its front outer casing or cover 6 is made of plastic. In the example shown, this front outer casing is assumed to contain the electronic functions of the shell, that is the fuse function of the shell, here indicated generally as 7, and also a mechanical safety arrangement 8. As both the fuse function 7 and the safety arrangement 8, are of known constructions, they will not be discussed in greater detail in this connection.

Figure 2:
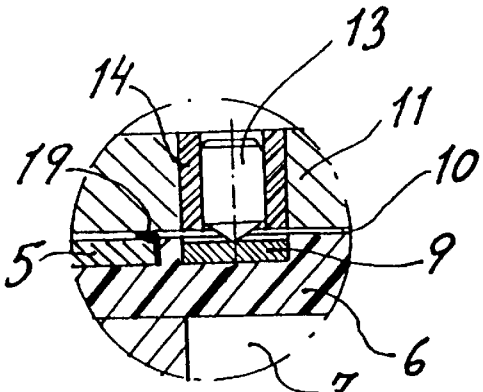
FIG. 2 shows an enlargement of the area circled in FIG. 1.

In the embodiment shown in the figure, the cover 6 which covers the electronic fuse function 7 is made of plastic, as a result of which it has been possible for an electrically conductive contact band 9 made of copper for example, which is designed according to the invention and arranged around the cover 6, to be let directly into the cover 6. As can also be seen in FIG. 2, the contact band 9 lies so deeply in the cover 6 that it will never be touched by the bars 10 of the barrel rifling in the barrel 11, in the cartridge chamber 12 of which the complete shot 1 is shown in the rammed-home position in the upper part of FIG. 1. At least one contact pin 13 is also partially let into the barrel 11. The contact pin 13 is otherwise electrically insulated in relation to the barrel by means of the insulation 14. Furthermore, the contact pin (contact pins) 13 is (are) arranged at the level of the position which the contact band 9 of the shells arrives in when the shells are rammed home in the cartridge chamber 12. A further characteristic of the contact pin (contact pins) 13 is that they protrude so far into the barrel that, with an adequate margin, they make good electric contact with the contact band 9 of the respective shell. Often, it may be appropriate, for ensuring good contact, to arrange three or more contact pins uniformly distributed around the periphery of the barrel. In theory, however, one would be enough.

The contact band 9 is connected to the programmable electronic fuse function 7 via the indicated connection 15 while the contact pin 13 is in turn connected via the cable 16 to the electronic programming unit 17 forming part of the weapon. The feedback between the programming unit 17, and the programmable electronic fuse function 7 of the shell, goes via the cable 18 to the barrel 11, and also from there to the metal shell casing 5 and back to the fuse function 7. The electrical contact between the inside of the barrel and the shell casing has been ensured by a thin collar-shaped contact plate 19, which has a diameter greater than the inside of the cartridge chamber 12, having been mounted in a groove in the shell body. When the shell is rammed home in the cartridge chamber, this contact plate 19, which is made of an easily deformed electrically conductive material, for example copper or aluminium, will be deformed exactly as much as required for the shell to be rammed home, and good contact is then achieved against the inside of the barrel. The feedback from the shell body 3 to the fuse function 7 has been indicated by the connection 20. In is the example shown in the figures, this contact plate 19 is clamped in a joint between the explosive-filled metal casing 5 of the shell and its front cover 6. In the lower part of FIG. 1, the contact plate is shown in its original, undeformed state.

With the arrangement shown in the figures, electric contact is therefore guaranteed in all situations between the electronic programming unit 17 and the programmable electronic fuse function 7 of the shell, as a result of which the latter is always ready, immediately before or in conjunction with firing of the shell, to receive a programming signal which contains information about the desired detonation range and/or detonation height. This is so that the maximum possible effect on the target can always be achieved. The programming unit can advantageously be connected to a sight and range-determining unit.

The same contact functions as described above for transmitting programming signals can also be used for supplying a charge or top-up charging voltage to capacitors included in the fuse function 7.

What is claimed is:

1. A shell-firing barrel weapon system for a single shot, semi-automatic or fully automatic firing, including a rifled barrel comprising a programming member for programming with programming pulses fuses in shells fired from the weapon before or in conjunction with firing of the shells, the system comprising:

at least one contact in the barrel of the weapon and connected to the programming member for transmitting a programming pulse from the programming member to the fuses of the shells, the at least one contact being electrically insulated from the barrel and protruding into the barrel beyond bars of rifling of the barrel; and an electrically conductive contact ring concentrically arranged on the shells, the contact ring being electrically insulated from main parts of the shells and having an external diameter that is smaller than a diameter of the bars of the rifling of the barrel, the contact ring being positioned on the shells such that when the shell is located in a cartridge chamber of the weapon the contact ring directly contacts the contact device, and electric feedback of a programming pulse from the programming member takes place via contact between the main parts of the shells and an inside of the barrel of the weapon.

2. The shell-firing barrel weapon system according to claim 1, wherein the programming member sets a detonation time and detonation range of the shells.

3. The shell-firing barrel weapon system according to claim 1, wherein the programming member sets a detonation time of the shells.

4. The shell-firing barrel weapon system according to claim 1, wherein the programming member sets a detonation range of the shells.

5. The shell-firing barrel weapon system according to claim 1, wherein the contact device is a pin.

6. The shell-firing barrel weapon system according to claim 1, wherein the barrel is made of steel.

7. The shell-firing barrel weapon system according to claim 1, further comprising:

a contact included on the shells, the contact comprising a thin easily deformed electrically conductive material that protrudes beyond an external profile of the shells and has a greater diameter than an internal profile of the barrel in the cartridge chamber, as a result of its shape the contact is deformed when the shells are rammed home in the cartridge chamber, thereby safeguarding against plat feedback of the programming pulse back to material of the barrel.

8. The shell-firing barrel weapon system according to claim 7, wherein the contact comprises a contact plate or contact collar.

9. The shell-firing barrel weapon system according to claim 1, wherein the fuse comprises capacitors that are charged up before the shells are introduced into the cartridge chamber.

10. The shell-firing barrel weapon system according to claim 9, wherein the capacitors are top-up charged using a connection via the contact and material of the main parts of the shells when the shell is kept in a loaded position in the weapon for long periods without firing.

11. The shell-firing barrel weapon system according to claim 1, wherein programming of the fuse takes place immediately before or in conjunction with firing of the weapon.

12. A method for programming shells fired from a shell-firing barrel weapon system for single shot, semi-automatic, or fully automatic firing, wherein the weapon system comprises a rifled barrel and a programming member for programming with programming pulses fuses in shells fired from the weapon before or in conjunction with firing of the shells, the method comprising:

transmitting the programming pulses to the fuses of the shells through at least one contact device in the barrel of the weapon and connected to the programming member and through an electrically conductive contact ring concentrically arranged on the shells, the at least one contact device being insulated from the barrel and protruding into the barrel beyond bars of the rifling of the barrel, the contact ring being electrically insulated from main parts of the shells and having an external diameter that is smaller than a diameter of the bars of the rifling of the barrel, the contact ring being positioned on the shells such that when the shell is located in a cartridge chamber of the weapon the contact ring directly contacts the contact device, electric feedback of a programming pulse from the programming member takes place via contact between the main parts of the shells and an inside of the barrel of the weapon.

* * * * *